United States Patent [19]

Brown

[11] 4,016,794

[45] Apr. 12, 1977

[54] MUSICAL INSTRUMENT SALIVA COLLECTOR

[76] Inventor: Lee A. Brown, 216 Kingsway, Temple Terrace, Fla. 33617

[22] Filed: Oct. 8, 1975

[21] Appl. No.: 620,510

[52] U.S. Cl. ..... 84/397

[51] Int. Cl.[2] ..... G10D 7/10

[58] Field of Search ..... 84/397, 387, 388

[56] References Cited

UNITED STATES PATENTS

| | | | |
|---|---|---|---|
| 791,034 | 5/1905 | Kreutzberg | 84/397 |
| 2,148,540 | 2/1939 | Dibert | 84/397 |
| 2,945,410 | 7/1960 | Ressler | 84/397 |
| 3,555,955 | 1/1971 | Sahaida | 84/397 |
| 3,635,118 | 1/1972 | Slovacek, Jr. | 84/397 |

*Primary Examiner*—Stephen J. Tomsky
*Attorney, Agent, or Firm*—Arthur W. Fisher, III

[57] ABSTRACT

A cup-like device designed to attach to various musical instruments for collecting and retaining saliva emitted from the water key during extended playing of such instruments.

6 Claims, 8 Drawing Figures

MUSICAL INSTRUMENT SALIVA COLLECTOR

BACKGROUND OF THE INVENTION

1. Field of the Invention

A cup-like device configured to collect saliva emitted from the water key of various musical instruments.

2. Description of the Prior Art

The problems associated with the accumulation of oil, saliva, and other liquids during the playing of various brass wind instruments such as trumpets, cornets, trombones, fluegelhorn, baritone saxophone and the like are well known to musicians. Without the provision of some means to intercept and collect such liquids, these various fluids are free to spray against the adjacent tubes of the instrument and musician's clothing or into the surrounding atmosphere which is undesirable from a health and ecological standpoint. A large number of attachments have been developed in an attempt to alleviate these problems.

Some such devices comprise means disposed within the tubing of the instrument. This type of structure interfers with the flow of the air through the instrument thereby impairing its performance. In addition, the frequent disassembly and reassembly to service these devices cause undesirable wear and tear on the instrument itself. Other well known devices are awkward to operate or unsightly and elaborate in design which detract from the overall appearance of the instrument. Still other attachments are mounted in such a manner as to harm the surface of the instrument to which it is attached. Many devices have a severely limited quantitative capacity for retaining the liquids accumulated.

Thus, it is apparent that there is a need for an inexpensive, effective, and attractive device or attachment for collecting the discharge of saliva and other fluids resulting during the play of various brass wind instruments.

SUMMARY OF THE INVENTION

The present invention relates to an enlarged, cup-like device designed to attach to various musical instruments to collect and retain saliva emitted from the water key during extended playing of such instruments.

More specifically, this device comprises a bottom wall having a substantially U-shaped cross-section, a forward and rear wall and two substantially flat side walls, which in combination form an open enlarged enclosure. Extending across the upper edges of the side walls and integrally formed thereon is a first fastening means comprising a velero material which engages a second fastening means of similar velero material attached to the musical instrument to securely fix the device to the instrument. The forward portion of the device is enlarged and extended in bulbous fashion to increase the capacity of the device and permit actuation of the water key.

In addition, a plurality of longitudinally disposed ridges may be formed in the inner surface of the side walls to serve as a retaining means for insertion of an absorbent material. Alternately, the bottom of the device may include a rim or ridge formed on the uppermost protion thereof which extends inwardly therefrom lengthwise to operatively engage correspondingly disposed grooves formed on the outer surface of the vertical disposes side walls whereby the bottom is removably attached to the side walls. The detachable bottom portion itself may be disposable or simply retain a disposable absorbent material.

Alternatively, the velcro fastening means may be replaced by a separate wire-like fastening means configured to encircle the instrument tubing and retain the cup-like enclosure between two parallel members extending rearwardly from the water key.

The device is attached to an instrument by the velcro fastening means.

The operator then simply actuates the water key allowing saliva to flow into the device where it is absorbed in the absorbent material. Periodically the fastening means is removed from the tubing and the absorbent material replaced. With the detachable bottom, the bottom is removed to replace the absorbent material or the bottom itself. The device is then reassembled and mounted on the instrument. Of course, the entire device may be disposable in view of its particular structure and design. This confines the saliva to the enclosure where it is absorbed by capillary attraction. This avoids contact with the saliva enhancing the hygienic characteristics of the device.

In the alternative embodiment, the wire-like fastening means is attached to the instrument. The cup-like enclosure is then placed between the two parallel members. As is the previously described embodiments, periodically the enclosure is removed to dispose of the saliva accumulated therein.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
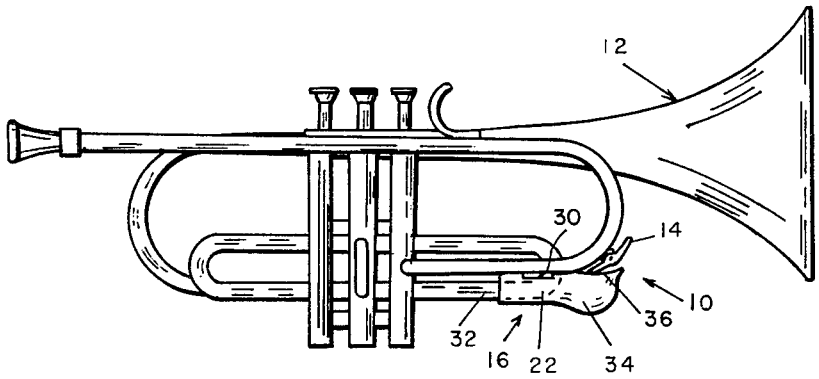
FIG. 1 shows a side view of a musical instrument with cup-like device attached thereto.

The present invention relates to an elongated cup-like device generally indicated as 10 in FIG. 1. The device 10 is designed to be attached to various brass wind instruments such as a trumpet 12 and is mounted immediately below and adjacent to water key 14.

Figure 2:
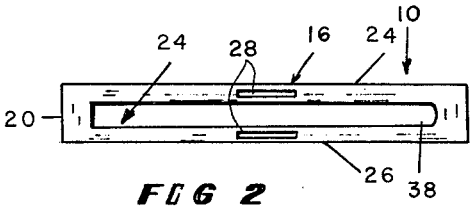
FIG. 2 shows a top view of the present invention.
Figure 3:
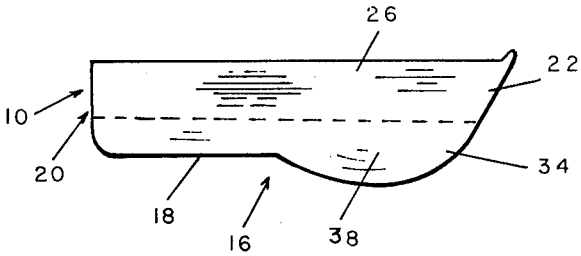
FIG. 3 shows a side view of the present invention.

As seen in FIGS. 2 and 3, the device 10 comprises a cup-shaped enclosure 16 including a bottom wall 18 having a substantially U-shaped cross-section, rear wall 20, arcuated forward wall 22 and substantially flat side walls 24 and 26. Extending across side walls 24 and 26 is first fastening means 28. First fastening means 28 comprises velcro material which engages a second fastening means 30 of similar velcro material attached to tubing 32 of the instrument 12 to operatively engage the tubing 32 and securely fix the device 10 to the instrument 12.

As best seen in FIG. 3, the forward portion 34 of the cup-like device 10 has a substantially bulbous configuration. This permits actuation of the water key 14 by allowing lever 36 of the water key 14 to pass down into bulbous portion 34 without the device 10 interferring with the lever 36. In addition, this bulbous portion 34 provides a greater collecting capacity.

Figure 4:
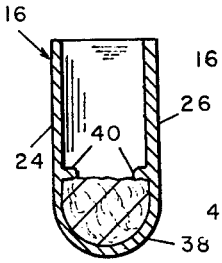
FIG. 4 shows a cross-sectional end view of an alternate embodiment.

As best shown in FIGS. 2 through 5, an absorbent material 38 is placed in the bottom portion of the device 10 to absorb and collect the saliva as it is emitted from the water key aperture (not shown). As shown in FIG. 4, ridges 40 may be formed in the vertical side walls 24 and 26 as a means of holding the absorbent material in place within the device 10.

Figure 5:
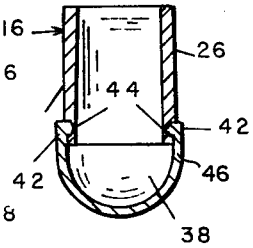
FIG. 5 shows a cross-sectional end view of an alternate embodiment.

In the alternate embodiment shown in FIG. 5, longitudinally disposed grooves 42 are formed on the outer surface of the side walls 24 and 26. These grooves 42 are configured and positioned to operatively engage ridges 44 longitudinally disposed on the upper portion of bottom 46 of the device 10. This bottom 46 is made of resilient material and accordingly may be snap fitted onto and removed from the side walls 24 and 26. Bottom 46 may be either disposable itself or simply contain disposable absorbent material 38.

Figure 6:
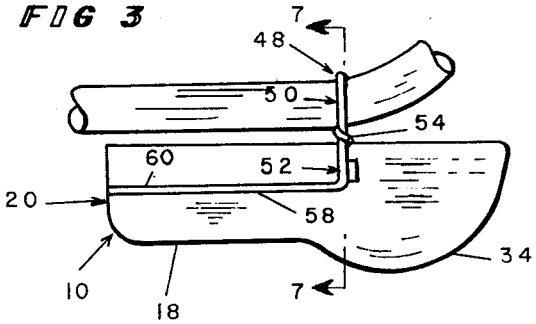
FIG. 6 shows a side view of an alternative embodiment of the device attached to an instrument.
Figure 7:
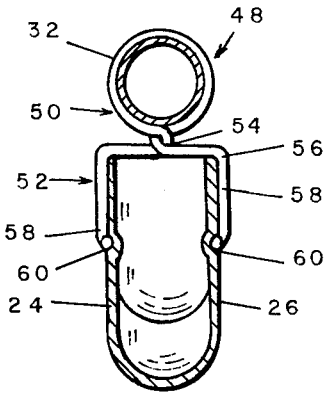
FIG. 7 shows a cross-sectional view taken along line 7-7 of FIG. 6.

FIGS. 6 and 7 show an alternate embodiment wherein the device 10 is fastened to the tubing 32 by fastening means 48 including an upper portion 50 and a lower portion 52. The upper portion 50 comprises a circular member which fits snugly around tubing 32. The lower portion 52 integrally formed with upper portion 50 at juncture 54 comprises a horizontally disposed member 56 terminating at either end in a pair of substantially L-shaped resilient fastening arms 58 extending downwardly and rearwardly therefrom. The arms 58 are spaced to fit tightly into grooves 60 formed on the sides 24 and 26 of the device 10.

Figure 8:
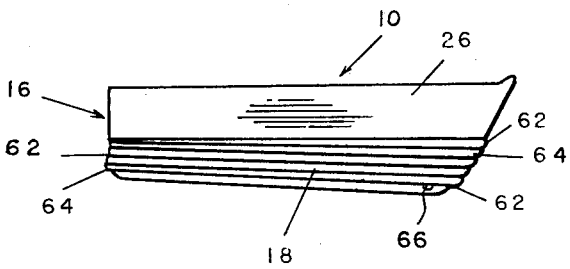
FIG. 8 shows a side view of still another alternative embodiment of the device.

FIG. 8 shows still another embodiment wherein the enclosure 16 comprises an accordion-like flexible material having a plurality of longitudinally disposed ridges 62 and troughs 64. The bottom 18 of the enclosure 16 includes a normally closed aperture 66 whereby the saliva may be dispelled from the device 10 merely by pressing the sides 24 and 26 together forcing the saliva outward through the aperture 66. The enclosure 16 may be similarly mounted by velcro 28 or fastening means 48.

In use the musician simply attaches the device 10 to the instrument 12 by engaging corresponding velcro surfaces 28 and 30. Once the device 10 is in place, it is a simple matter to actuate the water key 14. Since the bulbous end 34 is immediately adjacent and below lever 36, the saliva or condensation is blown from the tube 32 and into bulbous end 34 when the key 14 is opened. From time to time, the device 10 is removed from instrument 12 to permit replacement of the absorbent material 38. In the alternative embodiment of FIG. 5, it is not necessary to unfasten the device 10 but simply to snap off and replace bottom 46 or to replace the absorbent material 38.

In the alternate embodiment shown in FIGS. 6 and 7, the upper portion 50 of fastener 48 is mounted securely on tubing 32 immediately behind the water key 14. With the arms 58 riding within grooves 60, device 10 is moved rearwardly until the vertical members of the arms 58 engage the vertical portion of groove 60. Once in place, the device 10 will remain securely attached to the instrument 12. The device 10 is removed from the instrument 12 merely by reversing the process.

Of course, the entire device may be disposable in view of its particular structure and design. This confines the saliva to the enclosure where it is absorbed by capillary attraction. This avoids contact with the saliva enhancing the hygenic characteristics of the device.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A cup-like device designed for use with a musical instrument including at least one tube having an aperture formed therein and a water-key formed on the tube movable between a first and second position to selectively open and close the aperture to collect saliva and other liquids emitted from the water-key when in the first position, said device comprising a substantially rectangular enclosure having a substantially bulbous configuration on the forward portion thereof, the forward portion of said enclosure being arcuate in shape to form said bulbous configuration to substantially surround the water-key within said enclosure when in either the first or second position and fastening means formed on said enclosure to engage the tube of the musical instrument such that said fastening means detachably attaches said device to the musical instrument.

2. The device of claim 1 wherein said fastening means comprises an upper portion configured to engage the tubing of said instrument and a bifurcated lower portion configured to engage said enclosure.

3. The device of claim 1 wherein the bottom of said enclosure is detachably mounted on the side walls of said enclosure by means of longitudinally disposed grooves formed on the lower outside portion of said side walls and corresponding ridges longitudinally disposed on the upper portion of said bottom wall extending inwardly therefrom, said ridges being of such size and dimension relative to said grooves to detachably snap fit into operative engagement with said grooves.

4. The device of claim 1 including means for securing an absorbent material within said enclosure, said means comprising a plurality of longitudinally disposed ridges formed in the inner surface of said enclosure.

5. The device of claim 1 wherein the bottom of said enclosure comprises a plurality of longitudinally disposed flexible ridges and troughs and said bottom includes a normally closed aperture such that said liquids are forced from said enclosure through said aperture when said ridges and said troughs are moved laterally relative to one another.

6. The device of claim 2 wherein said upper portion comprises a circular member encircling the tube and wherein said lower portion comprises a horizontally disposed member interconnecting two essentially parallel L-shaped fastening arms, said fastening arms extending downwardly and rearwardly from said interconnection member, said enclosure including substantially L-shaped grooves formed on the outer surface of said enclosure such that said fastening arms operatively engage said L-shaped grooves to secure said enclosure to said instrument.

* * * * *